US009884669B2

(12) United States Patent
Paturu

(10) Patent No.: US 9,884,669 B2
(45) Date of Patent: Feb. 6, 2018

(54) EMERGENCY DETACHABLE ISLAND RIG AND FIRE ESCAPE

(71) Applicant: Sumathi Paturu, Birmingham, AL (US)

(72) Inventor: Sumathi Paturu, Birmingham, AL (US)

(73) Assignee: Dr. Sumathi Paturu, Birmingham, AL (US)

( * ) Notice: Subject to any disclaimer, the term of this patent is extended or adjusted under 35 U.S.C. 154(b) by 0 days.

(21) Appl. No.: 14/756,974

(22) Filed: Nov. 3, 2015

(65) Prior Publication Data

US 2017/0120990 A1 May 4, 2017

Related U.S. Application Data

(63) Continuation-in-part of application No. 13/134,370, filed on Jun. 6, 2011, now Pat. No. 9,175,549.

(51) Int. Cl.

| | |
|---|---|
| ***E21B 43/01*** | (2006.01) |
| ***B63B 23/30*** | (2006.01) |
| ***B63B 29/02*** | (2006.01) |
| ***B63B 35/44*** | (2006.01) |
| ***G05D 1/00*** | (2006.01) |

(Continued)

(52) U.S. Cl.

CPC ..... *B63B 23/30* (2013.01); *B63B 29/02* (2013.01); *B63B 35/44* (2013.01); *B63B 45/04* (2013.01); *G05D 1/0011* (2013.01); *B63B 2713/00* (2013.01); *E02B 17/00* (2013.01)

(58) Field of Classification Search

CPC ..... E21B 43/0122; E02B 17/00; B63B 23/30; B63B 29/02; B63B 35/44; B63B 45/04; B63B 2713/00; G05D 1/0011

See application file for complete search history.

(56) References Cited

U.S. PATENT DOCUMENTS 4,356,789 A * 11/1982 Hammett ..... B63B 35/44 114/264
4,527,503 A * 7/1985 Connelly ..... B63B 23/00 114/264

(Continued)

FOREIGN PATENT DOCUMENTS

GB 2231844 A * 11/1990 ..... B63B 23/28

*Primary Examiner* — Matthew R Buck

(57) ABSTRACT

The invention describes a partially submerged 'Detachable Island Rig' (DIR) locked on a permanent 'under-water basement', to be instantly detached upon a rig-fire. The electrical wiring and metal tubing (with intervening rubber tubing) are cut and sealed, before the DIR disengages also from adjacent stationary rig. For stationing back onto the base, submerged despite changing tides, the buoyant forces of DIR are countered by a system of double pulleys within the basement, when also the DIR is aligned to be locked to the permanent base. The DIR has provisions for immediate functions of a conduction platform, living quarters, a basement entry, steering station, and uniquely designed life-boats and lift-boats. The 'water-seal' of the basement entry, not destroyed upon a rig-fire, serves as an ideal 'fire-escape' model, a safe refuge within the rig. A Continuation-in-part application extensively details water-sealed fire-escape devices of off-shore rigs, including a conventional jack-up rig.

4 Claims, 4 Drawing Sheets

Figure 1:
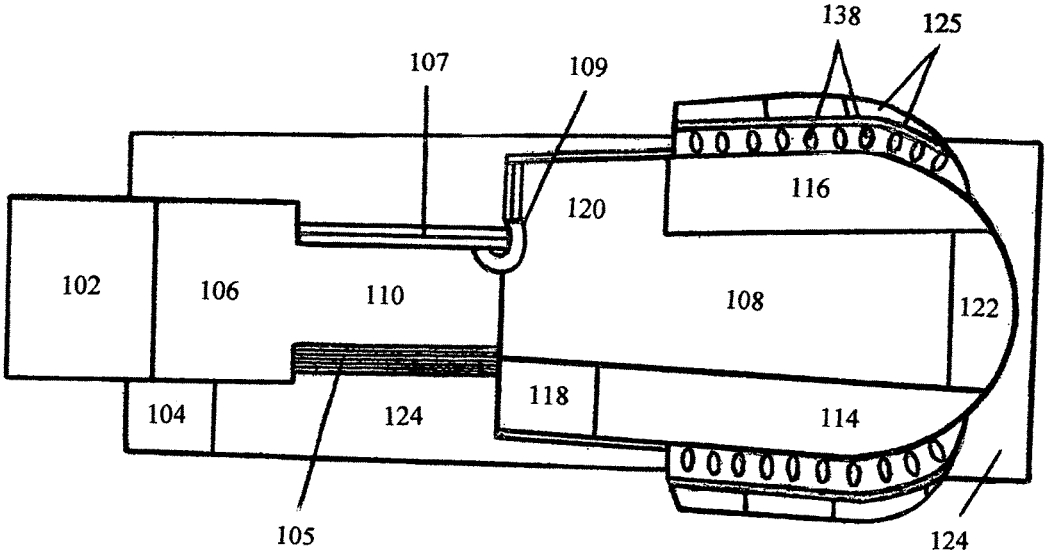

(51) Int. Cl.
*B63B 45/04* (2006.01)
*E02B 17/00* (2006.01)

(56) References Cited

U.S. PATENT DOCUMENTS

| | | | | | |
|---|---|---|---|---|---|
| 4,781,144 | A * | 11/1988 | O'Brien | B63B 23/32 | 114/365 |
| 4,861,299 | A * | 8/1989 | Ueberschaer | B63C 9/00 | 114/365 |
| 5,078,073 | A * | 1/1992 | Betz | B63B 23/60 | 114/377 |
| 5,597,335 | A * | 1/1997 | Woodland | B63B 7/082 | 114/345 |
| 6,138,605 | A * | 10/2000 | O'Brien | B63B 23/34 | 114/365 |
| 6,510,808 | B1 * | 1/2003 | Tormålå | B63B 23/38 | 114/365 |
| 6,920,839 | B2 * | 7/2005 | Pelley | B63B 23/28 | 114/378 |
| 7,131,878 | B2 * | 11/2006 | Austevoll | B63B 27/36 | 114/365 |
| 7,223,142 | B1 * | 5/2007 | McDonough | B63C 9/26 | 441/80 |
| 8,347,804 | B2 * | 1/2013 | Van Loenhout | B63B 21/50 | 114/230.1 |
| 9,109,406 | B2 * | 8/2015 | Lammertink | E21B 15/02 | |
| 2007/0051294 | A1 * | 3/2007 | Pike | B63B 23/00 | 114/348 |

* cited by examiner

EMERGENCY DETACHABLE ISLAND RIG AND FIRE ESCAPE

This is a CIP application of U.S. patent application Ser. No. 13/134,370, titled as 'EMERGENCY SALVAGE OF A CRUMBLED OCEANIC OIL WELL' (with a priority date of Jun. 6, 2011) which is herein incorporated by reference.

BACKGROUND OF THE INVENTION

There are innumerable petroleum oil wells bored into the oceanic floor by highly evolved modern technological devices to tap the petroleum (crude oil) reservoirs. Many oil wells are clustered in the Gulf of Mexico, Arabian sea, and such oceanic grounds, often of significant distance from the coast line, such wells bored through the ocean floor as far deep as a mile from the surface waters, to find their way into the underground oil containments spread many miles in area. Oil is collected from the wells into surface tanks in moderate containers, or into receptacles as large as ships.

The drilling and production of petroleum oil from the earth's mantle in the ocean floor is shrouded in risk and great hazard to the natural environment that includes both the marine life forms and the terrestrial ecosystem adjacent. The greatest hazard is the ignition of the entrained highly inflammable gases like Methane, causing dangerous fires coupled with the risk of oil spewing and polluting the sea water. Such two man-made calamities at the same time can be uncontrollable with available resources, and utterly devastating to the healthy existence of the earth's planetary life forms. For these reasons, error-proof safety systems in under-water bore well digging, and highly trained personnel are required by law in all countries engaged in significant oil production. Despite such stringent laws, system failures and catastrophic results did occur historically, and are still occurring, though the derived remedial measures through each 'adverse-event experience' uniquely different from the other in some form or other, are still nascent and less than perfect.

Recent event in the gulf shores of Mexico (involving BP oil company's oil well under construction, the Deep Water Horizon), wherein the ignition of the entrained Methane gas and its fire that continued unstopped for 36 hours, culminated in collapse of the surface structure of the oil well, resulting in an ever increasing gusher from the source. Several different attempts from BP oil company's technological, team to contain the spewing geyser from finding its way into the body of water and into the gulf shores, had failed, mostly due to the inherently limited robotic attempts, involved in a moderately deep aquatic habitat.

As any unforeseen adversity can happen at any time before the completion of the well to its last functional detail, safety measures to weather off such events at any step of the construction have to be in place, before beginning to undertake such operation. This CIP application enumerates a model of a Detachable Island Rig (DIR). This is one among the diverse measures described in the parent application by the Inventor Applicant, said measures however working in synchrony, to weather off any unforeseen event throughout the well construction and well operation. For the information of the said devices otherwise operative, the original application (titled as 'Emergency Salvage of a Crumbled Oceanic Oil Well'; U.S. Pat. No. 9,175,549) may be consulted. The original application is also a parent application for yet another CIP application enumerating prototype models of a 'Subsea Level Gas Separator of Oil Well Effluent', that include means and methods to be incorporated, beneficially at the most proximate site of the well head feasible, and at the earliest occasion, for preventing a giant gas bubble formation so as to keep the rig from being a venue of danger, difficult to contain. The subject matter is contextually relevant to any oil company, being also preventive in scope, of otherwise catastrophic and totally devastating consequences of a rig-fire. A CIP of this application will further disclose to the last functional detail, a model of an 'emergency fire-escape' accessible through a DIR, and also a similar model with some additional provisions that is workable to construct a 'fire-escape' for existing rigs (like most prevalent jack-up rigs) without a DIR/basement, however availing similar protections. The basic principles of an under-water 'fire-escape' is outlined in this disclosure, that has scope for many applicable ramifications.

Many inadvertent and unforeseen consequences were/are inherent to such ventures as the deep sea explorations and the like, shrouded in dangers and never ceasing mystery, and always counting on the tides of nature, yet to be conquered by the technological sophistication. Accordingly, the Author Inventor is neither legally liable nor personally responsible for any inadvertent errors or for any 'adverse events' difficult to differentiate either as a mere association or as a consequence of the application of the structural and procedural information herein enumerated. Structural or procedural application of this disclosure in different situations, innumerable and unique, is a personal choice. Furthermore, analyzing, and responding swiftly as needed, to diverse and unforeseen situations, still remain as the professional discretion, and the deemed responsibility of the involved company and its technological associates participating in the day to day practice in the implementation of this invention, in part or as a whole.

A drilling rig in its simplest form can be defined as an unit of equipment built to penetrate the superficial and/or deeper aspects of the earth's crust. The rigs can be built as small and portable to be moved by single person. However, they can be of enormous size and also suitably provided for complexity of functioning, so as to house equipment used to: drill oil wells; sample mineral deposits that can impede functional units; identify geographical reservoirs; and install underground utilities. Large units of drilling rigs, generally configured as more permanent land or marine based structures in remote locations are also facilitated with living quarters for laboring crews involved in well construction, at times hundreds in number. The rig can be permanently based in the sea, or floating with partial submersion.

Based on the cost of the multiple equipment of the rig and the life of personnel involved, even a major part of a permanently based rig may be constructed as a detachable island from the base structure and the area of conductor platform, the possible site of the initial fire or explosion. The detachable island is devised to be separated from said inciting site of fire, by a stretch of fire-proof corridor of sufficient length. Ground stability can be a considerable factor for the oil companies in opting for a permanent base. In the model herein described, the Detachable Island Rig is devised as an immovable structure with desired ground stability, yet with schema of provisions to quickly steer away from the permanent base platform, and the adjacent conduction platform, if the 'fire alarm' goes off as a warning to the crew.

BRIEF DESCRIPTION OF THE INVENTION

The embodiment of inventions herein disclosed is directed towards emergency devices that envision an emergency 'Detachable Island Rig' (DIR), to keep an off-shore oil well rig from being a venue of danger (and to possibly effectuate an emergency rig-salvage), resulting from a catastrophic ignition fire, proved difficult to contain.

The disclosure enumerates a 'Detachable Island Rig' (DIR) stationing on a stable concrete base and having a car door like locking device to be disengaging from or engaging with the base of a solid immovable structure. The DIR contains additional conduction platform, costly equipment, reserves, living and working quarters, and at the farthest end a steering station having powerful engine to speed steer in an automated straight course following a remote signal by the crew. For stationing back onto the permanent base structure that is built to stay submerged even by changing tides, the DIR is pulled down by a system of double pulleys situated in strategic positions on the sides of the base structure. The said pulleys have pull-over metal ropes hooked at their upper terminals to series of rings located at strategic places on the sides of the DIR when also the DIR is positioned to be locked to the permanent base structure. The metal ropes ultimately are pulled by yet another system of double pulleys located in the underwater basement or outside, the said basement also housing electrical generators, the 'power source' throughout the rig operation. The detachable rig has specially devised life-boats and lift boats (the latter to rescue seriously injured or unconscious fire victims from ocean waters) with wheels, the said boats stationed around the deck to be lowered into the sea by projectile ramps in the event the DIR also catching fire that cannot be contained.

DRAWINGS

FIG. 1: 'A Plan of an Emergency Detachable Island Rig'—a schematic diagram of a workable outline.

Figure 2:
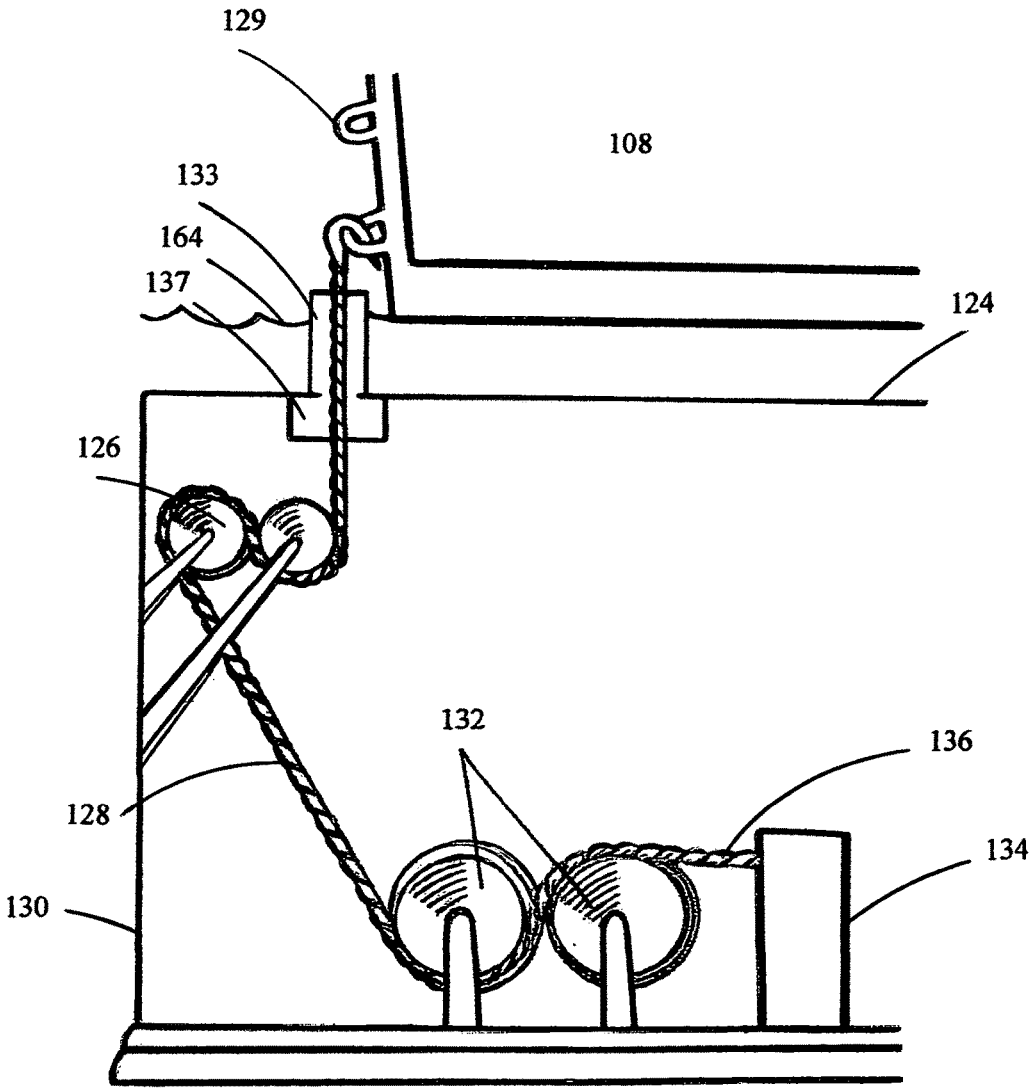

FIG. 2: A schematic diagram of 'An Anchoring Model of a Detachable Island Rig onto a Permanent Base Structure'.

Figure 3:
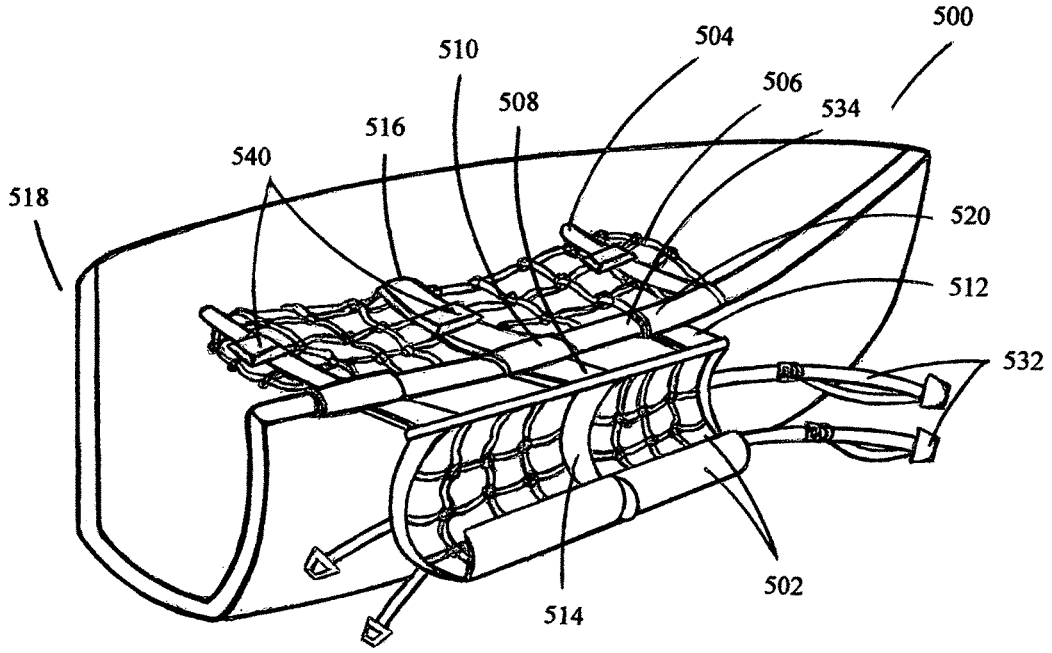

FIG. 3: 'A See-saw Hammock Design of a Lift-boat in a Detachable Island Rig'—a schematic, cut-section in part diagram.

Figure 4:
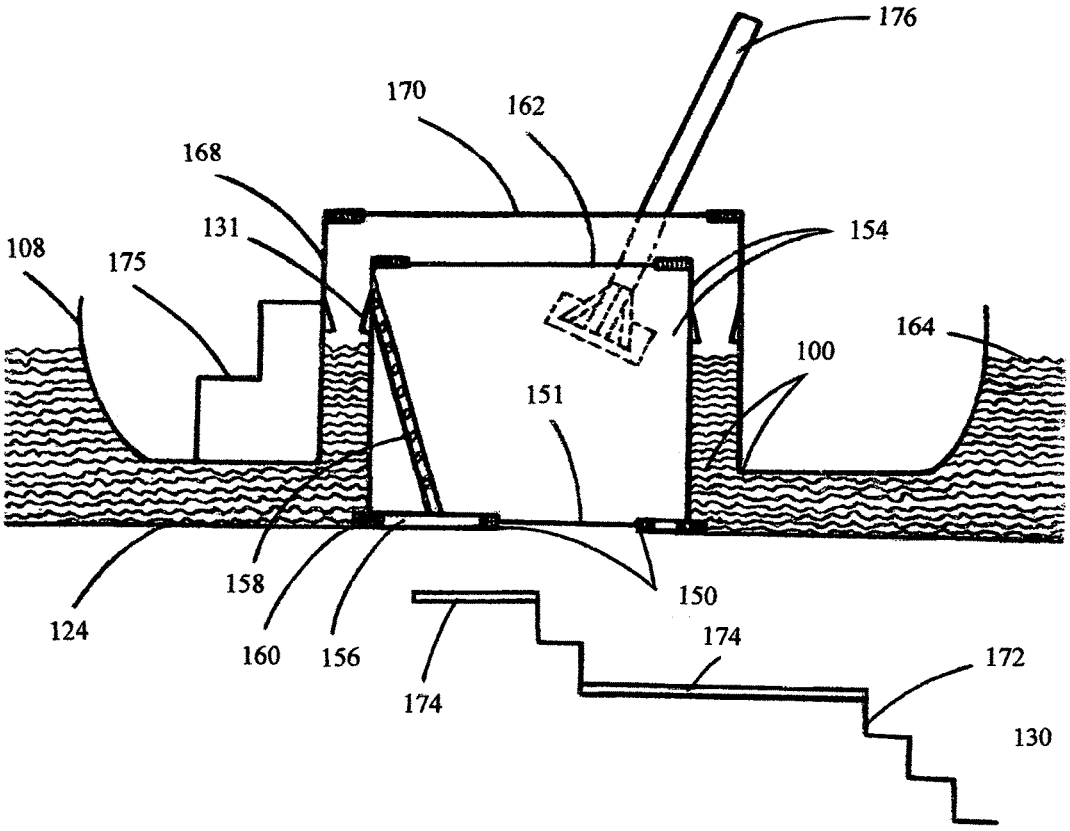

FIG. 4: A schematic illustration of 'A Model of an Under-Water Basement Entry in a Detachable Island Rig'.

DETAILED DESCRIPTION OF THE INVENTION

The embodiments of inventions herein disclosed are directed to devices effectuating an emergency salvage of an off-shore oceanic oil well rig that envisions an emergency 'Detachable Island Rig' (DIR) to be instantly steered away from the stationary rig, the inciting site of danger in the event of an ignition fire. The detachable Island Rig with also an uniquely designed basement entry and other novel amenities, is named after its inventor as 'Sumathi Paturu Model of DIR'. The disclosure enumerates the most effective scheme of a detachable rig that incorporates: 'water-sealed' basement entry that further serves as an ideal fire-escape, and 'life-boats' and lift-boats' structured for a safe exit plan—all the foregoing eminently suited to circumvent any catastrophic events, settings, and their consequences in a difficult to contain deep sea habitat.

The rig as described in the fore going sections, can be either permanently based in the sea, or floating with partial submersion. Based on the cost of the multiple equipment, and the life of personnel involved, even a major part of a permanently based rig may be constructed as a detachable island from the base structure and the area of conductor platform, the possible site of the initial fire or explosion.

Ground stability can be a factor in opting for a permanent base by the oil companies. In the model herein described, the Detachable Island Rig is an immovable structure with desired ground stability, yet with provisions to quickly steer away from the base structure and the adjacent conduction platform, if the 'fire/dangerous gas alarm' goes off, as a warning to the crew. The detachable island of the rig is devised based on the fact that there is no need for the whole rig to be destroyed with the fire feeding on itself incessantly, as in the manner it happened in the Deep Water Horizon Oil Well explosion, in the Gulf Shores. Whatever can be salvaged should be always salvaged, including all the personnel in one pack, working together for steering away the DIR from the source of fire, soon to be turning into a raging inferno.

FIG. 1 shows the schematic diagram of a plan outline of the proposed typical oceanic rig that includes a 'Detachable Island Rig' (DIR) within its structuring. Consistent with FIG. 1, on one end of the rig is the conduction platform 102 that also includes an appendage of fire station 104 with the crew. The adjacent segment 106 stations structures needed for the immediate operations of the conduction platform 102. The structures 102 and 106 are connected to the Detachable Island Rig 108 by a stretch of fire-resistant corridor 110, sufficiently long. The tubing and wiring running to the DIR 108, traverse both sides of the corridor, its one side accommodating electrical wiring 105, and the other side accommodating metal tubing 107. The metal tubing 107 is preferably substituted by a short segment of suitable rubber tubing 109 at the junction of the corridor 110 and the DIR 108. Every metal tubing in the rig has threading inside or outside, for needed immediate repair and intervening articulation by 'joint tubing' devised in I, L, C, J or T shapes having a complimentary threading with a straight or nested configuration.

The DIR as a whole is stationed on a concrete platform 124, the latter totally submerged in water, and behaves like a permanent base, configured on structures erected from the sea floor. The DIR being reversibly locked to the platform 124 of the permanent base, it is partially submerged in ocean waters.

The DIR 108 is detachable from the fire-resistant corridor 110, and houses costly and heavy equipment, working area 114 (having remote controls to the conduction platform, well head, and all functional and security devices), and living quarters 116. The devised separation of the DIR (from the area of the conduction platform) through the fire-resistant corridor 110 gives few minutes time for the DIR to escape from the fire, and to be steered away from the permanent base structure of the rig. The DIR 108 also accommodates a fire station 118 with its own crew, immediate provisions to operate a 'conduction platform', a 'security monitoring and response station' 120, and a steering equipment with a powerful engine positioned in the farthest end 122, similar to that of a small ship in its scope of operations. It is most suitable if any structure like a room or a wall, either in the fixed base represented by numerals 102, 104, 106, or in the DIR 108 are designed to be easily dismantled, to be arranged into a different configuration as needed, during the time of restructuring. The central portion of the DIR numbered as 108 is also an area for important heavy and immovable structural devices to be situated, in turn connected to the areas represented by numerals 114, 106, 102, and the structures represented by numerals 107, and 105. It also includes the area of basement entry, preferably nearer to the steering station at 122. The areas represented by numerals 102, 104, 106, 110 are located at a higher platform as the DIR itself, and the fire-resistant corridor 110 is connected to the DIR by a short watertight walkway, and it is shut off on the side of the corridor 110, by a watertight closure when the DIR needs to be detached, as the DIR's own watertight closure is also shut off. The schematic of FIG. 1 only shows the possible plan of the rig, but may not precisely represent the true shapes, exact dimensions, or a true operative configuration of a workable model of an off-shore rig, as it is only intended to show a workable plan by which the detachment of the DIR 108 can be easily accomplished, and how the plan should be geared towards that goal.

The concrete platform base 124 of the DIR 108 is so structured that it is at a sufficiently low level from the water surface, and the island rig 108 is steered down onto it, to be immovably locked in a desired position. To that effect, suitable mechanical forces have to be in place to overcome the built-in buoyant forces of the DIR, and bring it down by few inches, to be rested on the solid base 124. A device of double pulleys 126 as shown in FIG. 2, strategically positioned at multiple sites on the side walls within the basement 130, are devised to maneuver a set of sliding metal/steel ropes 128, their upper ends hooked to the ringed structures 129 on the sides of the DIR 108. Additional rings 129 can be positioned at higher levels also, as such higher positioning at times may be better operable for the steel ropes 128, to be exerting downward traction on the DIR 108. Traction of the steel ropes 128 on all pulleys 126 simultaneously will bring down the DIR 108 by few inches on to the concrete/steel base 124, to be stationed on it in desired position.

The underwater basement 130 also houses additional sets of double pulleys 132 (in the corresponding positions of the pulleys 126 located on the walls), also working on the sets of steel ropes 128, exerting traction in a complimentary direction, the movement of the terminal part 136 of the metal ropes 128 being aided by the electrical forces of the motor equipment 134. In the maneuvered position of approximation of the pulleys 126 and the rings 129 positioned for a downward traction, the DIR 108 is also in a position for locking with the permanent base structure 124, the latter effectuated by remote controls. After a secure locking, the steel ropes are detached from the rings 129 of the DIR.

The model described needs a suitable structuring that fits for an underwater basement (the floor of the permanent base 124 and the roof of the basement are considered synonymous in this description, and are used interchangeably). Such model is also shown in the FIG. 2. Each metal rope 128 emerges from a small roof window of the basement 130, after its watertight window door is opened. The FIG. 2 depicts an open window door. The emerged metal rope 128 passes through a 'rope tubular' 133 that is erected from the roof 124 of the basement 130 (after the DIR returns to the permanent base), the upper end of the tubular 133 rising above the water surface 164. The said tubular 133 articulates as a car trunk-like water tight closure, with a complimentary structure on the permanent base 124. Beneath the roof window door there is a roof compartment 137 inside the basement 130, where the upper end of the rope 128 is normally saved. The roof door can be locked or opened by a 'key' that is common for the multiple roof window doors that are about 6-8. The 'rope tubular' 133 is structured in dimensions manageable by a single person. Following an articulation, the water within the tubular 133 is suctioned out. The roof door is then opened by the key, the upper end of the metal rope 128 brought out from the roof compartment 137, and its terminal hook engaged to the ring 129 on the side wall of the DIR. It is done to all the traction ropes 128, to exert downward traction on the DIR simultaneously. The roof compartment 137 has on/off switch to turn on the motor equipment 134, to exert its downward traction on the metal rope 128. The roof compartment 137 has a solar powered light source to aid any activity after a night fall. As the weight to be pulled down is substantial, the force to be exerted by the motor 134 should be powerful. After the DIR is locked in position, the ropes 128 are disengaged, saved in the roof compartments 137, and the roof doors locked, following which all the 'rope tubulars' 133 are disarticulated from the base 124. All the 'rope tubulars' 133 are kept in the DIR, to serve their intended purpose. The 'rope tubular' 133 is sufficient in its dimensions that a man can stand within it on the permanent base 124. A ladder structured like a V is used to get into the 'rope tubular' 133, the diverging limbs of the V ladder placed within and outside the tubular, steadied outside by a person, as one gets into the tubular. There is structuring also on the base 124 to steady the ladder. These numbered land mark areas on the permanent base 124, are signaled by solar powered lights that are covered by strong metal grid over glass, both in flush with the base floor, said lights put on as soon as the DIR is detached. As the DIR is being stationed, the crew will align the ringed DIR structures 129 in line with the lighted basement roof windows, wherein a 'fine adjustment' via the 'caster wheels' will follow. It is an option that the numbered 'rope tubulars' 133 and their complimentary structuring on the permanent base are made with 1" difference between each, so that the largest tubular can accommodate the rest of them like a stack, to be kept in a space saving manner within the 'security station' 120 of the DIR.

To contribute additional weight to pull down the DIR, large metal pillars, or pillars solidly filled with concrete can be chained to the legs of the jack up rig, at a deeper level of the ocean. Each pillar has a top air capsule with a nozzle that is closed and locked normally, so that the pillar is made buoyant, creating no strain on the legs of the rig. When the DIR is positioned to be pulled down, divers bring down metal chains fixed to DIR to be anchored to the pillars, then disengage their chains to the legs, and open the nozzles to let the air out from the pillars, so that the real weight of the pillars come into effect. Similar contribution of weight from pillars all around will add significant downward traction on the DIR, so that the electrical power finally exerted by the motor 134 will be effective. After the hectic pace calms down, water will be suctioned out of the air capsules of the pillars, while air is simultaneously injected, when they are ready to be tied to the legs again, while disengaged from the DIR itself.

In right positioning the DIR 108 can be locked (or unlocked) by mechanical equipment similar to the locking of a car door (in magnified size with an allowance for some imprecision) by a remote control. These locks are multiple and are located all around the floor of the DIR, except in the area of 122, where the engine motor for the DIR steering is located. Control buttons for locking and unlocking can be pressed one after the other, all being also controlled by a single universal button for each side, amounting to a total of three. With a press of the fourth button following the upward rise of the DIR to the water surface, the engine of the steering station 122 is activated to take an automatic straight course until the control is taken over by the crew. The DIR is structured to have retractable wheels, omni-directional (the caster wheels), for finer adjustment (all four wheels being controlled to work in synchrony) of the DIR's positioning on its base platform. Other mechanical anchoring devices available in the market can also be used additionally or in the place of car-door like locking device, for the immovable stationing of the DIR.

At the junction of the fire resistant corridor 110 and the DIR 108, a crash cart is equipped to disconnect the metal tubing 107, and the wiring 105 that connect the two areas 110 and 108. Each tubing and wiring is differently color coded, and every member of the crew including the fire fighters should know how to instantly disconnect or severe, and clamp or seal each tubing and the wiring. At the junction of the corridor 110 and the DIR 108, the metal tubes 107 are made of short connecting segments of rubber tubing. If they are coursing on the wall, this part of the connecting rubber tubing should have a U or C configuration 109 for easy clamping and cutting. The ends of each metal tubing 107 adjacent to the C or U junction can be clamped by any conventionally structured mechanism, before cutting the intervening rubber tubing. The wiring 105 is carefully cut and sealed/insulated on either side. Working with remote devices as much as possible should be the priority to minimize the wiring within the DIR.

The signal to unlock the locking devices of the DIR from its permanent base structure 124 should be set by the key personnel carrying the remote control, as soon as the connecting tubes 107 and wires 105 are severed. Similar signal also activates the engine to speed steer the DIR 108 in an automated straight course away from the venue of danger. Multiple sheets of wet jute burlap stored in reserve at strategic places in a roof structure of the rig, and above heavy equipment, and thrown on burning objects/equipment, or affected crew members, is the most effective way of putting off the fire, even from inflammable gases, in conjunction with instantly closing the tubular systems (with the devised threaded configuration of all the tubular systems, through their entire lengths, and also the devised 'closing caps' with complimentary threading, as envisioned in the instant invention, to be detailed subsequently) to shut off the unceasing inflammable gas emissions at any level, from a broken and otherwise irreparable tubular system. The stored burlap sheets/rolls should be instantly made wet by outporing jets of sea water. Additionally, the costly equipment can be wholly jacketed/sheathed with layers of fire-proof structure during manufacturing, their tubing connections threaded throughout to establish a subsequent connection in case their connecting tubing or appended structures are destroyed.

If the DIR 108 had caught fire before or after its detachment, powerful sprinklers spread all around, jetting water from the sea, should be activated, and control of fire should be easier as the DIR 108 is moving away from the source of danger. Life boats 138 with wheels are also kept in reserve on board. They are positioned all around the periphery of the DIR 108 in guarded enclosures to be mobilized into the water over sloping projectile ramps 125, the latter slid into water by remote control.

The crew can move away only as far as it is deemed safe, but continuously working on the security and functional devices through remote controls, keeping vigilance on the expert professional fire crew left on the deck, working on preventing the well explosion. The DIR with crew can return to the permanent base as soon as the fire is put off, and station the DIR 108 to start the reparative process. Quick surface demolition can be done, as in this situation, clearing of the wreckage into the ocean is easier and less time consuming than a ground demolition. The basement housing the generators should be diligently constructed, to withstand any calamity so that immediate electrical circuiting is restored, as soon as the basement access is established (to be described later). Once the emergency reparative processes to restore the temporary well integrity followed by reparative processes to restore the permanent well integrity are accomplished by plurality of measures as was described in the original application (titled 'Emergency Salvage of a Crumbled Oceanic Oil Well), any further new and planned structuring of the rig can be done, for needed ongoing maintenance. Work and the amenities needed in the rig at the time of well maintenance are not as demanding as those needed at the time of well-digging.

When it is clear by all means that the fire can not be contained by any available techniques, and staying back can only endanger the lives of the fire-fighter crew, every crew member should steer away, and nobody left behind. It is in the best interest of the crew that everybody gets training in basic fire-fighting, though few are experienced and highly skilled. Those skilled, and stayed back, should plan to jump into the ocean in life threatening situations, or when they catch fire that could not be contained. They must dive-in as long as they can, in case they had caught fire (to avoid surface oil or crude that may not be visible in darkness) and must swim to clearer waters, that is, towards the darkest direction, and away from the rig/fire. The DIR crew should have powerful binoculars to keep vigilance, and as they steer away, they should let out some lift-boats stationed on the base structure, into the ocean, that are anchored to the stable rig platform by lengthy ropes, so that the fire fighters who jumped into the water can reach them.

When the detachable rig 108 returns to be stationed onto the permanent base 124 after a rig-fire destruction followed by needed demolition, all the locking devices if not properly operative, even few in strategic positions, especially about the opposite corners, are effective for a stable DIR stationing, further aided by other mechanical devices, if required. The electrical generators needed for the whole operation of the rig being housed under water, their chances of getting destroyed in fire is minimized, the equipment being the ultimate 'power-house' for survival off-shore.

A Model of Basement Entry

The rig basement apart from being a storage room, is a secure 'power-house' for the electric generators needed for the whole operation of the rig. However, it can be a matter of concern, to access the underwater basement on a regular basis without an unwanted compromise of this vital structure. The schematic of the access model is shown in FIG. 4. In this model, there are two rectangular room-like enclosures. An 'outer' permanent DIR enclosure (PDE) 168 is erected from a DIR floor window (DIRW) opening 100, and an 'inner' detachable stair case room (SCR) 154, is erected from the basement platform 124, configured around a basement roof window (BRW) 150. The structuring is detailed as follows.

The rectangular DIR floor window (DIRW) opening 100, located farthest from the conduction platform 102, and adjacent to the steering station, is the structural disposition best suited for the purpose of the basement entry. On the permanent base platform 124, a rectangular basement roof window 150 of the basement 130, is constructed in a position corresponding to, but substantially smaller than the DIRW opening 100. The basement roof window (BRW) 150 has a water-tight door/closure 151, similar to that of a car trunk-like closure or a car roof-like closure that can be unlocked by mechanical means as well as remote control, and the BRW door (BRWD) 151 lifted up/slid from the roof window 150. The car trunk closure refers to the trunk's whole hood-like piece with a hinge-joint, though mostly in a flat-configuration with a minimal vertical bend (about the opposite side of the hinge joint) that snaps to lock, and lifts when opened. It can also be structured like the top piece of a gift-box, all four sides bent, wherein one side is fixed in a hinge joint, with multiple locks about the other three sides, and its top in flush with the base platform. Both the BRW 150 and BRWD 151 are built with fire-resistant material, or such surface-cover. Outside the borders of the BRW 150, there is a provision on the basement platform 124 to articulate with a rectangular erectable staircase room (SCR) 154, made of four walls, the said walls to be articulated in situ with a complimentary structure 160 about the basement platform, to create the said SCR 154 around and above the BRW 150. The footage dimensions of the SCR 154 about the BRW 150 on one side 156 is greater to accommodate a broad stair-case or a ladder 158 and also space for two or three men to stand. The ladder 158 is fixed above to a wall of the stair case room 154, and steadied below by two parallel rails. The articulations 160 of the SCR 154 with the basement platform 124 is also similar to a car trunk closure that can be unlocked with remote control. The car trunk-like locking incorporates only the vertical free end of the car's hood-like piece, devoid of its horizontal element. The four walls of the SCR 154 however have multiple reinforcing locking structures. The SCR 154 is indeed erected into, and is communicating with the DIR 108 through an open DIRW 100. The SCR 154 itself has a stair case room (SCR) access window door (SAWD) 162 at the top. The height of the erected SCR with tailored dimensions is deemed to surpass the level 164 of the ocean waters, even during the occasional rise of the ocean tides. The permanent DIR enclosure (PDE) 168 structured on the DIR floor around the SCR 154, covers the latter with its own watertight DIR closure (DC) 170. The permanent DIR enclosure (PDE) 168 is a sturdy concrete structure of the DIR. The SCR access window door (SAWD) 162 and DIR closure (DC) 170 are configured as one piece closures, both to be lifted up onto the same side, to avail a large entry needed for manipulations with a prong, to transfer any utilities or large structures. There are spacious steps 175 from the floor of the DIR 108, to reach the top of the permanent DIR enclosure (PDE) 168.

The roomy underwater basement 130 has a sturdy and wide staircase 172 with 'standing-structures' (SS) 114, said SS situated just below the BRWD 151. That is, when BRWD 151 is opened, the SS 174 are immediately accessible from the ladder area 156, and the other three sides of the SCR 154. The DC 170 and SAWD 162 can be usually kept open. The opposing sides of PDE 168 and the SCR 154, near their upper ends, are provided with 'projectile wedge structures' (PWS) 131 all through the four walls—so called for their wedge-shape in a vertical cut section, giving the space between the said PWS 131 a 'nested configuration', to easily place (and remove) water-tight 'sealing planks' on all four sides, reversibly restrained in place, so that the ocean water is shut off from the interiors of the DIR and the SCR, during unexpected perturbations of the ocean tides. The SCR exterior being exposed to only few layers of water tides, it is protected even from the worst ravages of the ocean. The BRWD 151 is always locked (to be safe-guarded from unforeseen circumstances from within the rig), except during the time the basement 130 is entered. There can be spacious work platform on the DIR floor adjoining the DIR enclosure (PDE) 168, to facilitate easy transfer of utilities to and from the basement, a lift prong being used for the purpose.

The two sides of the SCR 154 at the top are securely connected to lift-prongs 176 that work by remote control, to lift up the SCR structure 154 from the base structure 124, after the SCR 154 is unlocked from the base articulation 160, by remote control. This provision is essential in the event of a rig fire, for the DIR's disengagement, to be steered away from the permanent base 124. It is instantly feasible, as the DC 170 is always kept open. The SCR 154 can be of sturdy plastic or vinyl, except the side the ladder 158 is resting, wherein both the latter structures (the ladder and its adjoining side of the SCR 154) can be made of steel, to facilitate a lighter weight for lifting the SCR 154. The DIR enclosure (PDE) 168, structured around the SCR 154, will not prohibit disengagement of the DIR, once the SCR 154 is lifted up from within, as the DIR enclosure (PDE) 168 is indeed part of the DIR structure. A mobilized DIR when returns to the base structure after a fire, the same SCR 154 can articulate with the BRW 150, that functions in a similar manner as before. The BRW 150 being always closed, and situated below the level of the surface water 164, the basement 130 will be never involved in fire, by virtue of the created water-seal, even when it is too late for the DIR 108 to be steered away.

The exterior of the SCR 154 at the top, is securely connected to lift-prongs 176 that work by remote control, to lift up the SCR structure 154 after it is unlocked from the base articulation 160, also by remote control. This provision is essential in the event of a rig fire, for the DIR's disengagement, to be steered away from the permanent base 124. It is instantly feasible, as the DC 170 is always kept open. The SCR 154 can be of sturdy plastic or vinyl, except the side the staircase/ladder 158 is resting, wherein only the latter structures (the ladder and its adjoining side of the SCR 154) are made of steel, to facilitate a lighter weight for lifting the SCR 154. The DIR enclosure (PDE) 168, structured around the SCR is not prohibitive for disengaging the DIR, once the SCR 154 is lifted up from within, as the DIR enclosure (PDE) 168 is indeed a part of DIR structuring. A mobilized DIR when returns to the base structure 124, the same SCR 154 brought down by the lift-prongs from within the DIR enclosure (PDE) 168, can lock with the base platform structures 160, that will operably function in a similar manner as before. The BRW 150 being always closed, and situated below the level of the surface water 164, it wilt be never involved in fire, by virtue of the created 'water-seal', even when it is too late for the DIR 108 to be steered away.

Even when the DIR is set on fire with no perceptible means of salvaging it, it is a good idea to still steer the unit by few designated members off from the base structure, so that some distance away, they can stop the engine, and jump into the ocean waters after mobilizing the boats, so that the wreckage tumbles into water. Such measure saves possible damage to the basement roof entry structure. It is a safety measure despite the basement roof and its entry built as break resistant and fire-proof. Additionally, even though the DIR has car door like locking devices, they are, as was mentioned, structured with some imprecision, and hence the articulation is not water-proof (unlike a car door), as shown in the FIG. 2 and FIG. 4, that depict some intervening space between DIR and the basement roof. Said space is devised to be more about the area of the basement entry, to create a better 'water-seal' that protects the basement even if the DIR could not be mobilized.

The Basement Entry as Fire-Escape based upon the virtue of the 'water-seal' as described above, created about the basement window door protecting it from a rig fire, the basement can serve as an 'emergency fire-escape' also, located within the confines of the rig. The CIP of this application will disclose how the fore going model of basement entry through the DIR itself, with needed modifications of additional protections around the entry structure, like a 'spray room', can serve as an instant 'fire-escape'. It will also enumerate similar model with needed measures to construct a 'fire-escape' for existing rigs (like most prevalent jack-up rigs) without a built-in DIR/basement, or a provision for such an elective structuring thereof.

Special Features of the Rescue Boats, Devised for Off-Shore Rigs

The DIR is provided with life-boats and lift-boats, their modeled prototypes similarly useful in any type of rig. Each type of boat is operably devised to be serving different purposes.

The life boats—a life boat devised for the rig has special features needed of its intended purpose. Most of the boats are stationed in the DIR, and few in the stable rig platform, being also fastened to their enclosures by lengthy chains. They have provisions for the 'rescued' to get in swiftly, as fire can be spreading on the water surface and to facilitate that, the boats have two hanging ladders on one side. On the other side, the hemi-section of each boat is built much heavier to prevent the boat from toppling. Alternatively, the boat can have helium-filled sacs positioned centrally, secured to the inside of the boat by Velcro bindings on either side, whereas a person before boarding, disengages the binding on the opposite side, and secures the helium sac totally to the side of the ladder, so that the boat will not topple while he tries to climb up. After boarding, the sacs can be repositioned as before. Being secured to the interior of the boat, the chance of the helium sacs getting punctured is minimal. The boats have wheels in the bottom to mobilize them over the sloping floors of their enclosures, and over the sloping projectile ramps. The boat on the side of the ladder is painted with alternate black and white stripes (to aid approaching from the right side of the boat), whereas the rest of the boat is painted white that helps enhanced visibility in darkness. The boats should have solar-powered batteries for the light source that can be activated by remote control (simultaneously when the ramps are mobilized) in the event of a catastrophic consequence happening after the nightfall. All the boats should also have fire resistant surface, secured oars inside, and snaps for instant disengaging of the metal chains, to steer away from the rig. The first-aid materials for fire victims, including analgesics (i.e. pain killers, like Tylenol) should be stored in a water-proof compartment in each boat.

The boat-enclosures—the deck enclosures of the boats facing the ocean side, are structured in a manner that they have a triangular disposition in a vertical plane, with about a 105° angle conforming on the rig side, and about a 30° angle conforming on the ocean side. The roof 125 (FIG. 1) of the enclosure, conforming to the diagonal plane of the triangle also functions as a projectile ramp when slid down completely into the ocean waters, for the boats with wheels to then slide down from their sloping floors onto the ramps. If the sloping roof 125 is lengthy, it makes a smooth incline of the ramp. Each boat need not have its own roof, and instead, a common roof can be formed for 4-5 boats, with confining boundaries made on the roof surface, for each. The floor of the enclosure being down sloping towards the ocean, the roof structure is normally restraining the boat in its enclosure. Once the roof is completely projected down into the water by remote control, to be transformed into a ramp, the boat wheels slide down onto the ramp, and there upon into the ocean waters.

A boat returning to the rig, should approach the ramp cautiously. The boarder should secure the metal chain nearby, snap it to its connection within the boat, and then get into water to enter the enclosure, wherefrom he can pull the boat onto the ramp, working on the metal chain. He hooks the fastening chain to an adjoining wall to steady the boat temporarily within the enclosure. The wheels of the boat make it easy even for a single person to draw up the boat into the enclosure. The ramp is made to retreat about its sideward ramp tracks, to its roof positioning, aided by the remote control. The repositioning of the roof can be delayed until all the boats return, if it is a common roof for multiple enclosures. Thereupon, the chains are loosely secured to their enclosure fasteners, set forth to maintain their entire length. If multiple boats are let down into the ocean about an emergency, even if not boarded, they stay afloat in water connected to their lengthy 'fasteners', and can be returned to their enclosures.

The lift-boats—In addition to the life-boats there can be 'Lift-boats' in the rig, solely meant for rescuing severely injured crew members to be lifted up from the ocean waters into the boat however, incorporating most of the features of the life boats. Though a victim can be pulled easier underwater, lifting him up into the boat is harder, as once the victim is above the surface of water, the weight in air comes into force, and additionally, the rescuing person has no solid-footage to bear and lift even a moderate weight. A very strong person may tilt the boat totally down with one hand, to roll the 'rescued' into the boat with the other hand, and then straighten it for himself to be getting in from the opposite direction. But every crew member may not be that strong.

The FIG. 3 illustrates the schematic model of a lift-boat 500, better devised to be larger than life-boats so that more than one person to be nursed, can be accommodated. To provide room and stability, its bottom is best made as flat base rather than a sloping base. A cut-section in part 518 of one side of the boat interior depicts such flat based structural arrangement. The boat has a lift-hammock (LH) 502 on one side of its exterior. The said LH 502 is made of a strong nylon net that also has a weather resistant canvas underneath as a lining, and is covered by soft padded sheet (not shown in the FIG. 3), tied to the hammock on four corners by Velcro bindings. The soft padded sheet of the LH 502 also has pillow-like thickened cushions on either side, to prevent head injury to the victim by any sudden tilting of the boat. The curved cradle like LH has a strong centrally positioned metal-framed wooden-support 514, and similar but smaller side supports, perpendicularly connected to a short central plank 508, and short side planks 512 on either side, said planks 508 and 512 fixed to the boat by movable hinges 510 and 520, rotating on the axis of a metal or wooden rod 534, the devised structures to be functioning as a see-saw. On the other side of the boat, are two ladders, not shown in the figure. For descriptive purpose, the LH side of the boat is referred as hammock side (HS), and the ladder side referred as ladder side (LS). The boat has four wheels similar to life boats.

On the hammock side of the boat interior there is also a receiving hammock (RH) 506, made of nylon net not lined by a canvas, and supported by long side planks 504 of the said see-saw device. The center of the RH 506 is configured to have a sturdy plank 516 of the see-saw connected to a small plank 508 of the receiving hammock by a movable rotating hinge 510 that axially moves about the boat rod 534. The small plank 508 perpendicularly connected to the central support 514 of the LH 502, is devised as a strong structure. All the long planks of the RH 506 are connected by a cross bar adjoining the inside edge of the boat.

There are helium sacs, secured by Velcro, in the mid line of the bottom of the boat, positioned nearer to the corners, to be accessible, being not hindered by the RH 506. Few are attached also to the side wall on the HS, under the RH 506, to off-set the weight of the LH 502, that may otherwise down-tilt the HS of the boat, even before the LH 502 is occupied. Additionally, all the long planks of the RH 506, about half way from their attached ends, have removable heavy weight metal spheres securely attached to their under surface (not shown in the drawing), to contribute weight to the planks of the RH 506, and aid a rescuer trying to lift the LH 502. Their mid-positioning prevent them from hitting the bottom of the boat in a rough sojourn. Also about half way from the attached ends of the long planks, there are 'sponge holders' 540 on their upper surfaces, to hold the victim on the RH. The 'sponge holders' 540 are sufficiently large sponge blocks secured by Velcro bindings that the rescuer can undo one at a time, starting from any side, so that the 'rescued' is slid down to the bottom of the boat, in a controlled manner.

During rescuing of a burnt victim, the rescuer after swimming to the HS of the boat along with the victim, positions the victim in the LH 502. Objects being lighter in water, it is easily done, and the 'rescued' is secured by restraint belts 532 that have larger than usual size adjustable buckles for easy identification and handling. The Velcro bindings of the hammock cushion in the lower corners are untied at this point. The LH 502 being of moderate size, even two people can be belted at one time. Cross belting is more secure. Due to the weight of the victim in the LH 502, the rescuer must change the helium sacs from the mid line of the boat, to fix them to the Velcro bands of the side wall of the boat on the HS, unoccupied by the RH, to offset the tilt of the boat, so that the victim may not be submerged. Alternately, they can be secured under the restraint belts of the LH, if not pressing on any painful areas of the victim's body.

After getting into the boat, the rescuer will immediately position himself on the RH 506 to lower the long central plank 516 so that the small plank 508 and also the LH 502 will be lifted up as a result. The rescuer should stay in a best position to be able to pull and receive the victim into the RH 506, by holding the inside corners of the LH cushion, after disengaging the belts 532, and the upper Velcro bindings also at this time. The spaces between the network of the RH 506 are big enough and without canvas to accommodate the legs of the rescuer on either side of the plank, to sit or stand if either position is more convenient, and to pull the soft padding of the LH (not shown in the FIG. 3) onto the RH. After the victim is steadied against the sponge holders 540, the rescuer will get off from the RH, and carefully slide down the victim to the bottom of the boat, to belt buckle him at two places, when also all the planks of the RH are disengaged, to be slid down to rest against the side of the boat by secure fastenings.

The interior of the life-boat is protected by weather resistant canvas about the sides, and the bottom lined by bubbled air mattress. A bubbled mattress is better protected following an isolated puncture than a single-compartment air mattress. A sponge mattress is an alternative.

Lift-boat with inflatable lift mattress—in yet another embodiment the LH is provided with an inflatable mattress (securely protected by over-sized and expandable knotted mesh on the top, and further covered by properly sized padding, both allowing needed expansion) that can be air inflated by a pump securely protected inside a boat compartment. After a victim is restrain-belted (said belting will not hinder an upward expansion of the air mattress), the mattress (covered with canvas lining, and bound in four corners by Velcro) is air inflated to rise to the level of the edge of the boat. The air mattress is configured narrow in its width to be sufficient to accommodate the body of a victim. That is, it is structured and configured like an air-bench (that is lifted up in vertical height) rather than a standard 'air-mattress' that it is named as. It is also tied in strategic places to the back rest of the LH, to keep such configuration of a bench, even before it is occupied. The mattress can also have an incline in the top, towards the boat interior so that the victim can be slid inside easily. Additionally, it can have wide-cavity egg-crater like structuring throughout, with widest cavities in the centers of the side walls and the bottom, to minimize the air needed, yet serving the purpose of air-lift without compromising comfort. Air pumps and other devices made of metal are preferred, or else they are made to be in-built in the boat, to minimize any shocks and breaks. Solar-powered batteries are best suited for use. In the setting of the air mattress, if see-saw device is not chosen, a receiving hammock inside the boat is still desirable to safe-handle an injured victim. However, it is better to have the see-saw device also, as it is a sure (and swift) modality in case the air mattress had been accidentally punctured in the transit.

Multiple air pillows are also stored in the boat compartment of any boat along with IV (intravenous) transfusion fluids (vital in burns cases), few hospital gowns, breathing aids, analgesics (like Tylenol), and dressing supplies. The boat also has hooked rings on the walls to hang the infusion. All the wall-hooks in the boat interior are structured as 'near circles' so that whatever is hung may not be accidentally disengaged. All the crew members usually know how to start an IV as they are also trained in basic life support (BLS) while they are trained in basic fire-fighting.

Which Device to Choose is Solely Based on the Seriousness of the Situation

If basic life support (BLS) like mouth-breathing and chest compressions are immediately needed. It follows, what to use when depends on the seriousness of the situation. The air mattress is an easy device though finding the required air inflator in the boat followed by air inflating need few minutes to expend, yet with an uncertainty that the in-situ mattress is not punctured, as the knotted mesh is deemed to be protective only from abrasive punctures. Hence, it is wise to equip the boat with multiple devices that are called for in different situations, for a sure rescue. In the situation where the victim is unconscious, indeed it calls for immediate rescue, as it could be a mixed case of burns, smoke-inhalation, shock, and additionally drowning. If the rescuer, with best of efforts, cannot lift the victim positioned in the LH, the air mattress is the only choice, whatever be the condition of the victim.

A bigger rescue boat with sophisticated technology to lift the disabled victims is ideal, but in this situation the size of the boat should be far bigger to accommodate such technology. Additionally, as the oil/crude can be spreading on the water surface in the immediate vicinity of the rig, such rescue boat may not stay near by the rig to board more than one or two burnt victims, and the situation being chaotic, a burnt victim may tend to jump into water from any area of the rig, rather than trying to find the lift boat at a particular place. In such situation, it is better to operate all projectile ramps at once by universal remote control for the boats to slide down into water aided by wheels, so that a person can reach any one nearby. In a place heavily covered by smoke, and also when one's sensorium is deteriorating, rationally expected course is hardly accomplished. However, once out of the rig and is in ocean waters, a person can rescue others who had jumped along with into the ocean, and are in a far worse condition, when also there are few lilt-boats floating around nearby. It can be a situation wherein the fire had spread suddenly and there was no time to disengage the DIR, and the only measure possible was to operate the projectile ramps by remote control which every crew member should be always carrying.

Insurance coverage—the Insurance coverage of the damaged rig can be a factor in planning against a DIR. However, familiarity with the working devices of the old rig, remedial measures/damage control that can be immediately undertaken without losing precious time in a precarious situation when such measures are also easier than when they are under taken later, and most importantly, avoiding morbidity or mortality of the crew members, and many other aforementioned matters—are the factors in favor of constructing a detachable island rig. Finding a new rig that fits the company's immediate needs and options is enormously time consuming causing indirect waste of money in such time lost. The insurance premium can be lower, and an agreement may be planned for covering the needed construction, parts, and repair, to restore the fullest and the best functional state of the partly damaged rig, as such undertaking is very cost effective for the concerned insurance companies also.

The Vulcanized Rubber as the Structural Constituent

All the rubber washers or any assembly devices of rubber incorporated in the rig tubing, the water tight sealing of the basement's fire-escape entry, and in similar sealing of the modular units, are all made of vulcanized rubber, the only type that can resist the degrading attack by the petroleum analogs. They are also devised to be protected from sea water.

The Instant Joint Configurations and Closing Caps

The invention further envisions a model of tubing directed to all tubular systems, and their methods of instant system joining or closing, for all future oil-exploration units, or as a replacement-tubing for existing units. The said model of tubular system is structured to be having a deep threaded configuration on the inside or the outside, traversing the entire lengths. Inner threading is better (though manufacturing it can be more involved), as outer threading can collect sediment, and lose its precision. With outer threading, there must be a firm bristled brush in the armamentarium of tools, along with soap solution for a quicker cleaning (in instances said tubing was exposed to water for a period of time). Such treading of the tubing can be involving the well, the rig, the appended tubing structures of costly equipment (the manufacturers involved in this setting), and any structures in the well-vicinity, said tubing either small or lengthy, facilitating instant joining or closing of a broken or otherwise compromised system, aided by means of—(1) 'Instant joint-structures' devised to be shaped as I, T, J, L, C, U, Y etc. with similar inner or outer threading as the tubing itself, to be inserted thereof, for the system joining, when a conduit line is broken and interrupted. It can be understood that the insertion of the 'joint-structures' conforms to a 'sliding screw' arrangement, such 'sliding screw' model aided by two or more conjoining I shaped joint-structures' with complimentary threading on the opposite side. That is, the conjoining I joints have their threaded outer diameter smaller than the threaded inner diameter of the involved tubing system and the devised 'joint configurations', or else, their threaded inner diameter larger than the threaded outer diameter of the rest. On the other hand, when an I joint itself is suffice for simple conjoining, it can have a complimentary threading to be inserted all by itself, in a sliding screw arrangement. The functionally uninvolved middle part of the said instant joint-structure is enlarged externally for easy handling, even by the robotic maneuvers; or (2) 'Closing caps', also with complimentary threading to their stems (i.e. having a smaller dimension and outer threading, if the tubular system has an inner threading, and vice versa), to be threaded, for closing a system, when system joining is of no option. The functionally uninvolved external part of the stem terminal enlarges to a tubing double the size or more, ending in a very sturdy and massive closing cap, to resist enormous pressure at times exerted by the tubular system at the terminal, and the massive size of the cap with its similarly sized distal stem ensures easy manipulation, by robotic maneuvers. Simple closing caps with complimentary threading to the tubing are used to temporarily seal one end of a severed tubing (in case it has to be done simultaneously), while the other severed end is worked on.

How to Find the Source of Gas/Oil Leak, and Mending it

About the oil-tubing within the rig, and the oil collecting system throughout, oil (petroleum) sensing and inflammable gas sensing 'equipment' are placed at equidistance, each equipment numbered, defining the confines of its territory. When any oil or inflammable gas leak occurs, following a tubular damage for whatever reason, its territorial equipment rings its alarm first, though other alarms also ring later, as the leak spreads. The devised computer soft-ware notes the timing of all the alarms, however, the one that first rang, is the source (unless the leaks are multiple). The leak is confirmed by the adjacently numbered alarms that rang, immediately following the initial alarm. The computer monitor sets forth the chronology, for an instant information. The security crew familiar with all the numbered territories, should emergently deploy the instant joint structures. The 'production tubing' within the well has its own pneumatic plugging device, the 'Emergency Plugging Oil Conduit' (EPOC), disclosed in the original application (U.S. Pat. No. 9,175,549), to be deployed after a well blow-out and oil leak (to be done when the oil-leak is a mere spill when it is most effective, whereas it can be a formidable job when it had evolved into a spewing geyser, due to the ocean water finding its way into the oil-containment raising its pressure enormously, however said pneumatic plugging even early on, only possible along with other synergistic devices also disclosed in the original application, for which a functioning rig with intact or established well connection is paramount, a possibility with a functional DIR that had returned to the base (the present invention needs to be viewed in light of, and in conjunction with the said inventions in the original application, as the issue may arise 'why salvaging the rig', as there is insurance to pay back all the damages). As the 'joint structures' are fixed in their dimensions, the length of the tubing to be severed should be properly configured. On the other hand, the minimal length of the damaged tubing to be severed cannot be minimized any more, the number of joint structures (with one or more 'conjoining' I tubes, without or with 'joint-structures' respectively) are to be properly configured before severing the tube, one end temporarily closed by a simple cap, while the other is worked on. It needs to be noted that the I configurations can be structured as both 'joint-structures' as well as the 'conjoining tubes', the latter with complimentary threading. Both ends of the severed tubing is closed by 'closing caps', when joining is not an option. It is obvious, that the leak has to be insulated first, and all the needed tubing including the conjoining I tubes are articulated outside, following which one end or both ends simultaneously, are out, for the articulated set to be inserted. The final manipulations of the two conjoining I tubing are done in-situ, to establish a properly approximated conduit line, if necessary, also incorporating vulcanized rubber washers for fluid-tight closures. A grossly distorted and bent-over tubing may need an intervening U or C joint, whereas a normally L shaped and damaged curve needs an intervening L joint. The crew should have 'mock practice', and have sharp 'severance tools' for instant cutting of even sturdy tubing, during an emergency.

The tubing involved is any tubing, as was mentioned, wherein said configuration is deemed effective. Unceasing oil/gas emission from the source that can not be detected/mended is the reason for an unceasing fire, or else for an uncontainable pollution (recall the BP oil well blow-out with uncontrollable fire, and pollution of the gulf shores). Hence, such structural mandate is as important as all the other security measures put together, in an unpredictable and difficult to contain deep sea habitat, wherein nothing may be left to chance. Moreover, what needs to be herein implemented is only a small step forwards in means familiar, however, with a big leap thereof, in the remedial functions achievable.

The invention claimed is:

1. An embodiment of invention directed to an off-shore petroleum oil well rig, designed for salvaging the temporary and permanent functioning of the rig structure, incorporating a model of a partially submerged 'Detachable Island Rig' (DIR) stationing on a completely submerged permanent base, to be instantly detached and steered off from the base platform, upon the initiation of a rig-fire, the said DIR having herein set forth means and/or functions, as:

(a) provision to instantly unlock/lock by locking devices to be disengaging from or engaging with a completely submerged permanent base structure, comprising an underwater basement and an overlying basement platform, wherein upon disengaging, the partially submerged DIR separates from the completely submerged base platform and partly submerged adjacent stationary-rig structures, the latter encompassing: (1) a conduction platform with an appended segment equipped for immediate operations, (2) a fire-station, and (3) an intervening stretch of fire-proof corridor adjoining the DIR, said fire-proof corridor's metal tubes and electric wires instantly severed for disengaging the DIR, as watertight doors of both the corridor and the DIR are also shut, and a short watertight walkway between both is disconnected, (b) the DIR in an overall structuring having: provisions for immediate functions of an additional conduction platform, costly equipment, living and working quarters, an under-water-basement entry structure, a security monitoring and response station, and at the farthest end a steering station with powerful engine to smooth steer in an automated straight course, following a remote signal by the crew, (c) the DIR having its own fire station, and crew of fire fighters, as also the stationary rig of the permanent base structure, (d) incorporating said locking devices about both sides of the DIR, the locking devices designed to be allowing room for some imprecision, and operated by a remote control having a common button to each side, (e) having life-boats and lift-boats with wheels, stationed about a deck, the boats down-sliding into the ocean waters in the event the DIR also catching fire that cannot be contained, wherein: the boats having triangular enclosures in a vertical plane, with about 105° angle conforming on the rig side, and about a 30° angle conforming on the ocean side, the roof conforming to a down-sloping diagonal plane; the boats normally restrained on down-sloping floors by said down-sloping roofs; said down-sloping roofs also conforming to projectile ramps when completely slid into water by a remote control, the boats on wheels thereon sliding over the down sloping floors and the projectile ramps, (f) said metal tubing passing through the stretch of the fire-proof corridor conforming to short segments of rubber tubing having C or U configuration about the junction with the DIR, thereof effectuating easy severing of the tubing after clamping, (g) the DIR having projectile omni-directional wheels thereof facilitating a precise positioning about the base platform, (h) while stationing back onto the base structure built to stay submerged even by changing tides, the DIR is pulled down by motor-powered system of double pulleys set forth in strategic positions about the basement, said pulleys having pull-over-metal ropes passing through 'roof tubulars' erected over water-tight roof compartments of the basement, whereby the DIR is aligned also, to be locked to the permanent base, (i) the DIR having room in roof structures, to store large sheets/rolls of jute burlaps to be wet and thrown on burning mechanical devices of any height (the latter covered by fire-resistant sheaths/jackets upon manufacturing), or else on affected crew members, wherein said maneuvering is best effectuated in a setting with a provision thereof to instantly closing a broken tubular systems with an otherwise unceasing gas/oil emissions about the rig and the well vicinity, said tubular systems in their entirety having threaded configuration to be severed and closed anywhere, by 'closing caps' with a stem of the cap having complimentary threading, or else, connecting the broken system anywhere, by threaded 'joint 'joint structures' of diverse configurations, aided by at least two of conjoining I joints, with complimentary threading, and (j) the DIR's basement access is protected by an 'inner' and an 'outer' enclosures about an entry of a rectangular basement roof window (BRW) having a window door structured to be 'water-sealed' upon a rig-fire, and serving as an ideal fire-escape, wherein: (1) the 'inner' enclosure, a 'detachable' stair case room (SCR) above the BRW, rises up through a DIR floor window, to be surpassing the surface of the ocean waters, the walls of the SCR articulated in site with the permanent base adjacent to the BRW, said articulation configured watertight in a model of a snapping 'car-trunk closure', whereas the top of the SCR is covered with one piece SCR access window door (SAWD); (2) the 'outer' enclosure structured as a 'permanent' DIR enclosure (PDE) erected around the SCR, is covered on the top, by a one piece DIR closure (DC); (3) the BRW is closed by a 'water tight' basement roof window door (BRWD), similar to that of a lifting car trunk closure, or a sliding car roof closure, operated by mechanical as well as remote control; (4) The footage dimensions of the SCR floor around the BRW on one side is greater to accommodate a stair-case or a ladder, and few men to stand, the BRW accessed from the basement through a standing structure of a basement staircase; (5) the opposing wall surfaces of the SCR and the PDE, near their upper ends have wedge-shaped projectile structures on all four sides, giving a 'nested configuration' to the space between, wherein water tight 'sealing planks' with reversible restraints are placed to shut off the ocean water from the DIR and the SCR; (6) as the DIR is ready to be detached, the BRWD is locked, and the disarticulated, SCR lifted up by 'lift-prongs' through open DC, when the BRWD is 'water-sealed', to be protected from a rig-fire; and (7) the basement entry by virtue of a 'water seal', serving as an instant 'fire-escape', whether or not the DIR could be detached.

2. The schematic model encompassing the 'Detachable Island Rig' of claim 1, wherein the rig's life-boats operative in the event of rig-fire have special features set forth for the purpose, as:

(a) fire resistant surface, bottom wheels, two hanging ladders on one side, and an interior water-tight compartment storing basic medical-rescue supplies for fire-victims, (b) the whole boat painted white, having intervening black stripes about the side of the ladders, thereof identified as the side to be approached, (c) the boat's hemi-section on the opposite side of the ladders having thicker weight wood, preventing toppling of the boat with the weight of a 'rescued' climbing up the ladder, or alternatively, having detachable centrally situated helium filled sacs about the boat-interior, to be secured to the side of the ladders before boarding, preventing the board from toppling, (d) having secured oars inside, and instant disengaging snapping-joints of the anchoring metal chains, disconnecting the boat from the rig, and (e) having solar-powered batteries charging a light source, put on by remote control upon a rig-fire happening about a nightfall.

3. The schematic model encompassing the 'Detachable Island Rig' of claim 1, wherein the rig's 'lift-boats' operative upon a rig-fire, for lifting severely injured victims into the boats from the ocean waters, said lift-boats improvising the general features of life-boats, are otherwise set forth for the purpose, as—

(a) the lift-boat is larger than the life-boat, while the boat's bottom is made flat rather than sloping, (b) the lift boat's 'hammock side' having a lift hammock on its exterior, said lift hammock made of a strong nylon net, a weather resistant canvas, and a soft padded sheet tied on four corners by Velcro, the cradle-like lift hammock having curved metal-framed wooden supports about its center and side-wards, said supports perpendicularly connecting to small planks that are fixed to movable hinges about the boat-edge, the structuring set forth as a see-saw, (c) the lilt-boat's 'ladder side' having two ladders on its exterior, set forth for a rescuer to be climbing into the boat, (d) the lift-boat on the hammock side of the interior having a receiving hammock, made of nylon net without a lining or a padding, said receiving-hammock having long central and side planks connected to the small planks of the lift hammock by the rotating hinges of the sec-saw, thereof lifting the lift-hammock as the 'rescuer' lowers the central plank and the connected side planks, (e) the long planks of the receiving hammock having removable heavy weight metal spheres, secured midway about their under surface, aiding the 'rescuer' lifting the lift hammock, (f) the lift hammock secures the 'rescued' by restrain-belts, whereas the helium-filled sacs about the boat-interior, moved to the hammock side from the center of the boat, aids to off-set the boat's downward tilt on the hammock side, preventing the 'rescued' from submerging into ocean waters, (g) upon lifting the lift hammock, its soft padding along with the 'rescued' is pulled onto the receiving hammock, wherein he is held by 'sponge holders', their Velcro bindings undone one at a time, to slide down the 'rescued' to the bottom of the boat secured by restraining belts, the detachable long planks thence rested onto the side of the boat, and (h) the lift-boat having hooks to its side walls for hanging fluid infusions, said hooks conforming to near circles, preventing disengaging of infusion bags, a water-tight boat compartment providing said medical supplies.

4. The schematic model of the lift hammock of claim 3, wherein the lift hammock of the lift-boat is equipped with an in-situ inflatable air mattress covered by a over-sized protective net allowing room for an air-inflation, and an exactly-sized padded sheet about the top, the latter tied to all the corners by Velcro bindings, the air mattress truly conforming to an air-bench, has a narrow width and more of vertical height, to be best utilized for stable victims with expendable time about air inflating the mattress, thereof lifting the victim to the edge of the boat.

* * * * *